United States Patent [19]

Allen

[11] 4,152,028

[45] May 1, 1979

[54] EXPANSIBLE APPARATUS FOR REMOVING THE SURFACE LAYER FROM A CONCRETE OBJECT

[75] Inventor: Charles H. Allen, Pasco, Wash.

[73] Assignee: The United States of America as represented by the United States Department of Energy, Washington, D.C.

[21] Appl. No.: 880,920

[22] Filed: Feb. 24, 1978

[51] Int. Cl.[2] ..... E21C 37/02

[52] U.S. Cl. ..... 299/23

[58] Field of Search ..... 299/22, 23

[56] References Cited

U.S. PATENT DOCUMENTS

| | | | |
|---|---|---|---|
| 345,696 | 7/1886 | Hudson et al. | 299/22 |
| 900,003 | 9/1908 | Veitch | 299/23 |
| 3,565,488 | 2/1971 | Walsh | 299/22 |

FOREIGN PATENT DOCUMENTS

| | | | |
|---|---|---|---|
| 2630091 | 1/1977 | Fed. Rep. of Germany | 299/23 |

*Primary Examiner*—Ernest R. Purser
*Attorney, Agent, or Firm*—Dean E. Carlson; Frank H. Jackson; James W. Weinberger

[57] ABSTRACT

A method and apparatus for removing the surface layer from a concrete object. The method consists of providing a hole having a circular wall in the surface layer of the object, the hole being at least as deep as the thickness of the surface layer to be removed, and applying an outward wedging pressure on the wall of the hole sufficient to spall the surface layer around the hole. By the proper spacing of an appropriate number of holes, it is possible to remove the entire surface layer from an object. The apparatus consists of an elongated tubular-shaped body having a relatively short handle with a solid wall at one end, the wall of the remainder of the body containing a plurality of evenly spaced longitudinal cuts to form a relatively long expandable section, the outer end of the expandable section having an expandable, wedge-shaped spalling edge extending from the outer surface of the wall, perpendicular to the longitudinal axis of the body, and expanding means in the body for outwardly expanding the expandable section and forcing the spalling edge into the wall of a hole with sufficient outward pressure to spall away the surface layer of concrete. The method and apparatus are particularly suitable for removing surface layers of concrete which are radioactively contaminated.

1 Claim, 2 Drawing Figures

EXPANSIBLE APPARATUS FOR REMOVING THE SURFACE LAYER FROM A CONCRETE OBJECT

CONTRACTUAL ORIGIN OF THE INVENTION

The invention described herein was made in the course of, or under, a contract with the U.S. DEPT. OF ENERGY.

BACKGROUND OF THE INVENTION

This invention relates to a method and apparatus for removing the surface layer from a concrete object.

The surfaces of concrete structures such as the floors and walls of buildings housing nuclear reactors or fuel processing facilities are oftentimes subject to radioactive contamination. This contamination may be caused by neutron bombardment of the structure from radioactive sources or by spilling a solution containing radioactive material onto the surface. The radioactivity may penetrate a short distance below the surface either due to penetration of the surface by the radioactive particles or due to the natural porosity of concrete to liquids. Since, if this radioactivity is great enough, it may make the area dangerous for continued human occupation, it is imperative that the radioactivity be removed from the concrete or that the area be closed to future human occupation. Presently available methods for removing radioactive contamination from the surface layer of concrete are expensive, ineffective and possibly hazardous.

For example, the contaminated area may be removed by grinding off the surface layer. However, this method is very slow and hence expensive, and it raises a considerable amount of dust and may contribute to the spread of the contamination if the radioactive dust should become airborne. The use of this method is therefore limited to small areas of contamination because of the effort involved. The use of a torch to heat and spall small areas has also been used, but this may volatilize some radioactive isotopes, causing further contamination. The use of an acid to etch the concrete surface is still another method for removing contaminated layers. However, this may drive the radioactivity deeper into the concrete, making decontamination still more difficult. The simplest method is to seal off the contaminated area for a period of time sufficient for the radioactivity to decay to tolerable levels. However, this could involve the loss of expensive and valuable facilities for tens or even hundreds of years.

SUMMARY OF THE INVENTION

I have developed a method and apparatus for removing a surface layer of concrete which solves many of the before mentioned problems attendant with the use of presently available methods. By the method of my invention, a hole is provided in the surface layer to be removed, the hole being at least as deep as the thickness of the surface layer to be removed, and an outward wedging pressure is applied to the wall at the depth of the surface layer of sufficient pressure to spall or break the layer from the object around the hole, thus removing the layer from the concrete object. By the proper spacing of an appropriate number of holes, a surface layer can be removed from an entire concrete object. The apparatus consists of an elongated tubular-shaped body having a relatively short handle with a solid wall at one end, the wall of the remainder of the body containing a plurality of evenly spaced longitudinal slots to form a relatively long expandable section, the outer end of the expandable section having a wedge-shaped spalling edge extending from the outer surface of the wall perpendicular to the longitudinal axis of the body, and expanding means in the body for outwardly expanding the expandable section to force the spalling edge into the wall of a hole with sufficient radially outward pressure to spall away the surface layer from around the opening.

It is therefore one object of the invention to provide a method and apparatus for removing a surface layer from a concrete object.

It is the other object of the invention to provide a method and apparatus for safely and economically removing a radioactively contaminated surface layer from a concrete object while limiting the spread of the radioactive contaminants.

DETAILED DESCRIPTION OF THE PREFERRED EMBODIMENT

Figure 1:
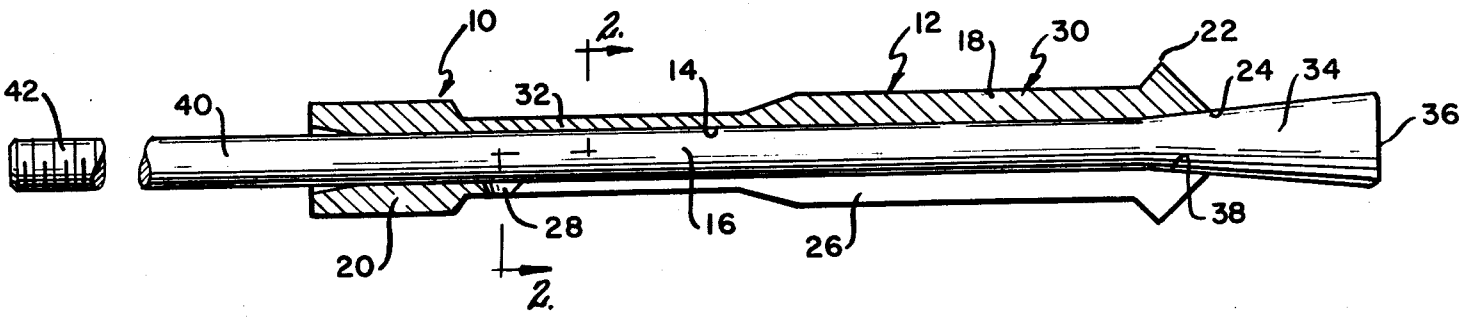
FIG. 1 is a cross-sectional view of the concrete spalling apparatus of the invention.
Figure 2:
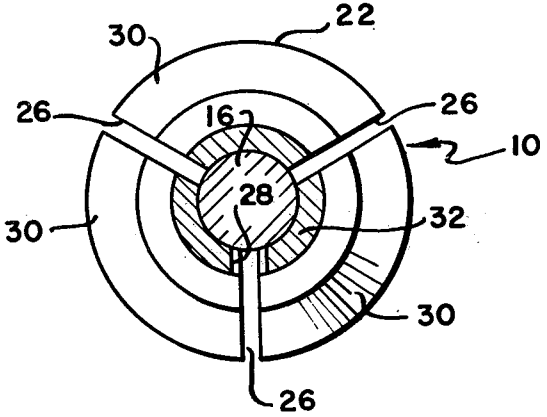
FIG. 2 is a lateral cross-sectional view of the apparatus of FIG. 1 through lines 2—2.

Referring now to the drawings, the apparatus 10 of the invention consists of an elongated tubular-shaped body 12 having a longitudinal axial passageway 14 and an elongated expander 16 in the passageway. The wall 18 from which body 12 is formed is solid at one end to form a relatively short handle 20 for gripping the apparatus. Opposite handle 20, a circular wedge-shaped spalling edge 22 extends outward from the outer surface of wall 18, perpendicular to the longitudinal axis of body 12 to form the spalling end 24. A plurality of longitudinal slots 26 are evenly spaced around the circumference of wall 18, extending from spalling end 24 to handle 20 where they end in stress relief holes 28, thus providing a plurality of longitudinal wall segments 30 extending from handle 20. A short portion of the wall of each segment 30 where it extends from handle 20 is relatively thin, forming a flexible neck 32 to permit the segments to be resiliently bendable outward and provide an expandable section. Expander 16 consists of a tapered mandrel 34 extending from spalling end 24, tapering outward to a large end 36, the taper of mandrel 34 matching and slidably engaging a short outward taper 38 on the inner face of each wall segment 30. The small end of mandrel 34 in axial passageway 14 is fixedly attached axially to one end of an elongated shaft 40 slidably located in passageway 14, having a free end 42 extending from the handle end 20 of body 12, the end being threaded for attachment to means (not shown) for imparting longitudinal motion to expander 16 relative to body 12 to complete the apparatus.

The expandable section of body 12 should be divided into at least three segments and may be divided into four or more to insure adequate expansion of the section and permit contact of the spalling edge with the walls.

In operation, the apparatus 10 is inserted into a hole in the surface layer of the concrete object so that spalling edge 22 is at or below the depth of the surface layer to be removed, the hole being just slightly larger in diameter than the diameter of edge 22. After placement, expander 16 is pulled longitudinally relative to body 12, thus pulling tapered mandrel 34 into body 12, against short taper 38, thereby urging wall segments 30 to bend outward to expand the expandable section and force circular spalling edge 22 into contact with the wall. Continued axial movement of shaft 40 will expand the section further increasing the radially outward wedging pressure applied to the walls by edge 22 and providing sufficient force to break or spall the surface around each hole away from the concrete body, thus removing the surface layer from the body.

The optimum hole depth and spacing will depend on a number of variable factors such as hole diameter, which is dependent upon wedging edge diameter, condition of the concrete and the surface and the depth of contamination which must be removed, and will have to be determined by experimentation in each individual situation. The holes should be generally perpendicular to the surface to provide a relatively uniform spalling area around each hole.

Movement of the expander relative to the body may be provided by any means capable of providing sufficient outward wedging pressure of the spalling edge on the wall to spall the concrete surface, such as a device operated by air pressure or by a hydraulically operated cylinder.

A number of experiments have been made using an apparatus similar to that described herein, made of tool steel. In the experiments, a number of one-inch-diameter holes two and one-half inches deep were drilled in aged concrete foundations. The holes were laid out in square patterns with center-to-center hole distances of 4, 5, 6, 7 and 8 inches and also in equilateral triangle patterns with hole spacings of 5 and 6 inches. The spalling tool wedges were inserted to a depth of 1 inch, the average force required was 1669 pounds with an average hydraulic oil pressure of 1441 psi. It was found that under these conditions the average spall area was about 6 inches in diameter around each opening. It was also determined that with a square pattern and 4-inch hole spacing, all the concrete surface was cleaned away.

As can be seen from the preceding description, the method and apparatus of this invention provide an efficient and effective means for removing the surface layer of a concrete object.

The embodiments of the invention in which an exclusive property or privilege is claimed are defined as follows:

1. An apparatus for spalling a surface from a concrete object comprising:

an elongated tubular-shaped body having a wall, a longitudinal axial passageway through the body forming an inner face and two ends, a relatively short section at one end having a solid wall to form a handle end for gripping the body, and a circular wedge-shaped spalling edge at the opposite end, extending outward from the wall to form a spalling end, the spalling edge being perpendicular to the longitudinal axis of the body, at least three longitudinal slots in the wall, evenly spaced around the circumference of the wall extending from the spalling end to the handle, to form at least three longitudinal wall segments extending from the handle, each segment having a short relatively thin-walled portion where it extends from the handle whereby the segments are bendable resiliently outward at the handle to form an expandable section, a short outward taper in the inner surface of each wall segment at the spalling end; and a tapered mandrel extending from the spalling end of the body, the mandrel having a large end outside the body and a small end in the axial passageway and a long shaft slidably located in the axial passageway having one end attached axially to the small end of the mandrel and a free end extending from the handle end of the body for imparting longitudinal movement to the mandrel, the taper of the mandrel matching the short outward taper on the inner surface of the spalling end, so that pulling the shaft longitudinally through the body will force the mandrel against the short outward taper bending the wall segments outward, thereby expanding the expandable section whereby inserting the spalling end of the apparatus into a hole in the surface layer of concrete and expanding the expandable section will force the wedge-shaped spalling edge outward into contact with the wall of the hole, continued expansion forcing the spalling edge into the wall to break the layer from the object, spalling the surface layer from the object.

* * * * *